US008602682B2

(12) United States Patent
Resler

(10) Patent No.: US 8,602,682 B2
(45) Date of Patent: Dec. 10, 2013

(54) HEAT EXCHANGE METHOD OF ARTIFICIAL UPWELLING

(76) Inventor: Carl Leonard Resler, Austin, TX (US)

( * ) Notice: Subject to any disclaimer, the term of this patent is extended or adjusted under 35 U.S.C. 154(b) by 300 days.

(21) Appl. No.: 12/505,443

(22) Filed: Jul. 17, 2009

(65) Prior Publication Data

US 2010/0014919 A1 Jan. 21, 2010

Related U.S. Application Data

(60) Provisional application No. 61/082,237, filed on Jul. 21, 2008.

(51) Int. Cl.
*F03G 7/04* (2006.01)

(52) U.S. Cl.
USPC ..... 405/52; 210/747.5; 210/170.11

(58) Field of Classification Search
USPC ..... 405/52, 60; 210/745.7, 170.09, 170.11
See application file for complete search history.

(56) References Cited

U.S. PATENT DOCUMENTS 4,051,810 A 10/1977 Breit
4,231,312 A * 11/1980 Person ..... 114/264
4,470,544 A * 9/1984 Bronicki et al. ..... 239/2.1
4,597,360 A 7/1986 Johnson

* cited by examiner

*Primary Examiner* — David Bagnell
*Assistant Examiner* — Benjamin Fiorello

(57) ABSTRACT

The present invention mimics the natural process of oceanic upwelling wherein deep ocean water rises into the photic zone and provides a nutrient rich environment for phytoplankton, the beginning of the marine food chain. The power of waves is utilized to cause a down-flow of warm surface water though a plurality of conduits. A heat exchange process delivers warmth to the deep water which rises in a conduit due to a buoyancy that results from the warming. Deep ocean water that is rich in nutrients is brought into the photic zone to facilitate the primary production of marine life. The present invention can convert a non-fertile ocean environment into a fertile ocean environment. This fertile ocean environment can be used for aquaculture and to restore and also to enhance marine populations. The present invention vertically mixes ocean water which has a multitude of other advantages.

5 Claims, 3 Drawing Sheets

HEAT EXCHANGE METHOD OF ARTIFICIAL UPWELLING

CROSS-REFERENCE TO RELATED APPLICATIONS

This application claims the benefit of provisional patent application Ser. No. 61/082,237, filed 2008 Jul. 21 by the present inventor.

FEDERALLY SPONSORED RESEARCH

Not applicable

SEQUENCE LISTING OR PROGRAM

Not applicable

FIELD OF THE INVENTION

Embodiments of the present invention relate to apparatus and methods for mariculture and more particularly to a wave powered heat exchange method of oceanographic upwelling.

BACKGROUND OF THE INVENTION

Ever since Thomas Malthus wrote his essay on population in 1798 there has been a debate as to when population growth would outpace the food supply. Dire predictions of mass starvation were apparently premature as the green revolution brought synthetic fertilizers, effective pesticides, genetically modified crops and the selective breeding of high yield varieties of crops. At present there is enough food produced to satisfy the 6.7 billion people who now live on the planet (if they all only had access to it). But land agriculture is water-limited, and as the population continues to grow, it is the ocean that shows the greatest promise for feeding a growing population.

Approximately half of the surface of the earth is a sunlit layer of ocean desert on top of an extremely vast reservoir of deep ocean nutrients. All of the ingredients required by photosynthesizing organisms are present in the pelagic ocean: sunlight, water, carbon dioxide and nutrients. However, these nutrients, notably nitrate and phosphate, are essentially exhausted in the top photic layer where photosynthesis occurs. It is also known that when and where the deep ocean upwells into the photic zone the result is an abundance of marine life. Along the west coast of Peru, for example, upwelling provides fisheries with about 10 million tons of anchovies annually. The areas of the ocean where natural upwelling occurs represent only a small percentage of the ocean surface, about one percent, yet these areas provide the fisheries with about 50 percent of their catch. The present invention mimics the natural upwelling using pipes.

Artificial upwelling has been addressed many times. U.S. Pat. No. 3,683,627 to Girden (1972) utilizes an air pump to introduce small bubbles in deep water thus reducing the density and causing it to rise. This technique has a disadvantage in that high pressure air is needed, and high pressure air pumps are expensive and cumbersome.

U.S. Pat. No. 4,051,810 to Breit (1977) uses a wave-driven mechanical hydraulic pump to drive surface water to the depths through a pipe that has a bend which directs flow upward at the entrance of a larger upwelling pipe. However, a large portion of the water upwelled originates at the surface, thus reducing the effectiveness.

U.S. Pat. Nos. 4,189,379 and 4,311,012 to Finley require an expensive desalination device.

U.S. Pat. No. 4,326,840 to Hicks and Pleass requires a mooring to the ocean floor, which is impractical for most of the deep ocean.

U.S. Pat. No. 4,597,360 to Johnson (1986) takes advantage of relatively dense water at the surface due to high salt concentration caused by evaporation. However, the necessary gradient of salt concentration is often not present in the deep ocean.

U.S. Pat. No. 5,267,812 to Suzuki et al. (1993) requires a structure to be built on the sea floor, which is impractical for most of the deep ocean.

U.S. Pat. No. 5,106,230 to Finley (1980) uses a supply of fresh water that originates above sea level. The supply of fresh water is not readily available in the open ocean.

U.S. Pat. Application 2008/0175728 to Kithil (2008) uses a buoy to lift deep water though a flexible conduit and a one-way valve. But moving parts such as valves often fail, and the deep water lifted into the photic zone being more dense than the ambient water has a tendency to sink.

Hence there is a need for a simple inexpensive device that provides equi-density upwelling to the photic zone, has no moving parts to wear out or fail, is durable in rough seas, needs no intervention to operate and can be left unattended in the remote regions of the deep ocean.

SUMMARY

It is a general object of the present invention to provide a means of facilitating the primary production of phytoplankton in the photic zone by mimicking the natural process of oceanographic upwelling.

Ocean surface waves provide an impetus for a down-flow in the present invention. Near the surface of the ocean, surface waves cause an increase of pressure. At a midpoint elevation between the crest maximum and the trough minimum of a wave, the absolute pressure at the trough of the wave is one atmosphere due to the weight of the atmosphere while the absolute pressure under the crest is greater than one atmosphere due to the extra weight of the water in the crest. The pressure averaged over time at the same midpoint elevation increases with increasing wave heights. Ocean surface waves do not significantly affect the pressure in deep water. A suitably oriented conduit with its top end near sea level and its bottom end well beneath the waves will have an average net pressure on it that initiates a down-flow.

The water carried in the down-flow from the surface is warmer than deep water. A plurality of down-flow conduits is employed in the present invention to move surface heat into the depths. The down-flow conduits are constructed of a heat conducting material and pass through the interior of a larger conduit, warming the deep water contained therein. The deep water in the larger conduit rises due to the buoyancy resulting from the warming.

This general arrangement of flow and conduits where a plurality of small conduits pass through the interior of a larger conduit carrying flow in opposite directions and designed to transfer heat energy between the flows is commonly referred to as a counter-flow shell-and-tube heat exchanger. Given the temperature and salinity profiles of the ocean, specific dimensions for the conduits, and a wave height, the rate of artificial upwelling can be predicted for this device.

DRAWINGS—FIGURES

DRAWINGS—REFERENCE NUMERALS

Figure 1:
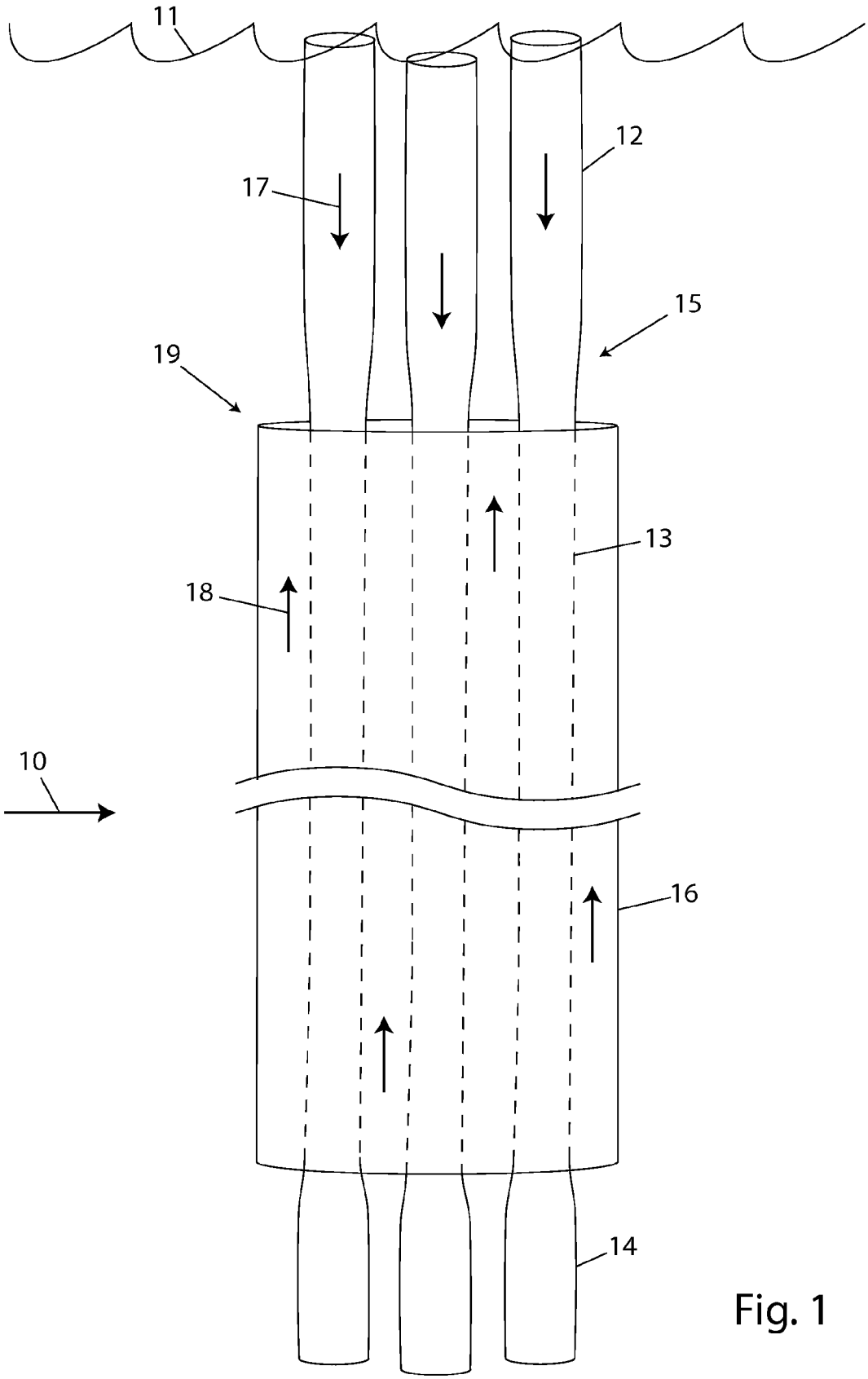
FIG. 1 is a side perspective view of a first embodiment of the invention.

10 ambient flow
11 ocean surface
12 header sections of down-flow conduits
13 heat exchange sections of down-flow conduits
14 footer sections of down-flow conduits
15 down-flow conduits
16 up-flow conduit
17 down-flow
18 up-flow
19 upwelling device
20 down-flow egress orifices

DETAILED DESCRIPTION

A first embodiment of an upwelling device 19 is depicted in FIG. 1. The upwelling device 19 is ballasted by any means (not shown) so that it resists vertical movement due to surface waves, and so that its vertical stance is not unduly perturbed by ocean currents, and so that the upper extent is sufficiently close to the ocean surface 11 such that the top ends of header sections of down-flow conduits 12 are in the region of increased pressure due to surface waves. A plurality of header sections of down-flow conduits 12 extend downward a distance of at least 30 meters from the ocean surface 11. The header sections of down-flow conduits 12 are not abutting one another at the surface but are sufficiently separated so as to not be a barrier to the motion of ocean surface waves. The header sections of down-flow conduits 12 are joined with tapers to heat exchange sections of down-flow conduits 13. The heat exchange sections of down-flow conduits 13 pass through the interior of an up-flow conduit 16. The heat exchange sections of down-flow conduits 13 are joined with reverse tapers to footer sections of down-flow conduits 14. The header sections of down-flow conduits 12 are fabricated of a durable, compliant, heat-insulating material such as polypropylene. The heat exchange sections of down-flow conduits 13 are fabricated of a heat conducting material such as aluminum treated with anti-fouling paint. A down-flow conduit 15 is comprised of one header section of down-flow conduit 12, one heat exchange section of down-flow conduit 13, and one footer section of down-flow conduit 14. To exemplify the magnitude of the anticipated dimensions of the up-welling device 19, the overall vertical dimension will range from 150 to 400 meters depending on local conditions affecting the performance of the device. Ambient flow 10 has a typical speed of 0.1 km per hour and carries upwelled effluent away from upwelling device 19.

Ocean surface waves provide an impetus for a down-flow 17 as depicted in FIG. 1. The absolute pressure at "sea level" when a sea is at rest is one atmosphere. Here, "sea level" is defined as a midpoint elevation between wave crest maximum and wave trough minimum. Due to the action of ocean surface waves, the absolute pressure, averaged over time, is greater than one atmosphere at sea level. The average absolute pressure at sea level increases with increasing wave heights. It is known that surface waves do not significantly affect the pressure in deep water. A down-flow conduit 15 oriented with the top end at sea level and the bottom end well beneath the waves may have the down-flow 17 within it due to "wave pressure".

Because the water at the surface of the ocean has a higher temperature than deep water, the down-flow 17 is warmer than the ambient water. A plurality of down-flow conduits 15 pass through the larger upwelling conduit 16 in an arrangement known as a counter-flow shell-and-tube heat exchanger. Heat energy is passed from the down-flow 17 within the heat exchange sections of down-flow conduits 13 to the water within the upwelling conduit 16. As the heat energy is passed the temperature is reduced in the down-flow 17 while the temperature increases in the water within the upwelling conduit 16. This creates a buoyancy within the upwelling conduit 16 and results in an up-flow 18.

The efflux from the footer sections of down-flow conduits 14 does not enter upwelling conduit 16 if the ambient flow 10 carries the efflux away, or the efflux is more dense than the deep ambient water and sinks. Down-flow efflux that enters the up-flow conduit 16 may dilute the upflow and decrease the effectiveness of the device.

Figure 2:
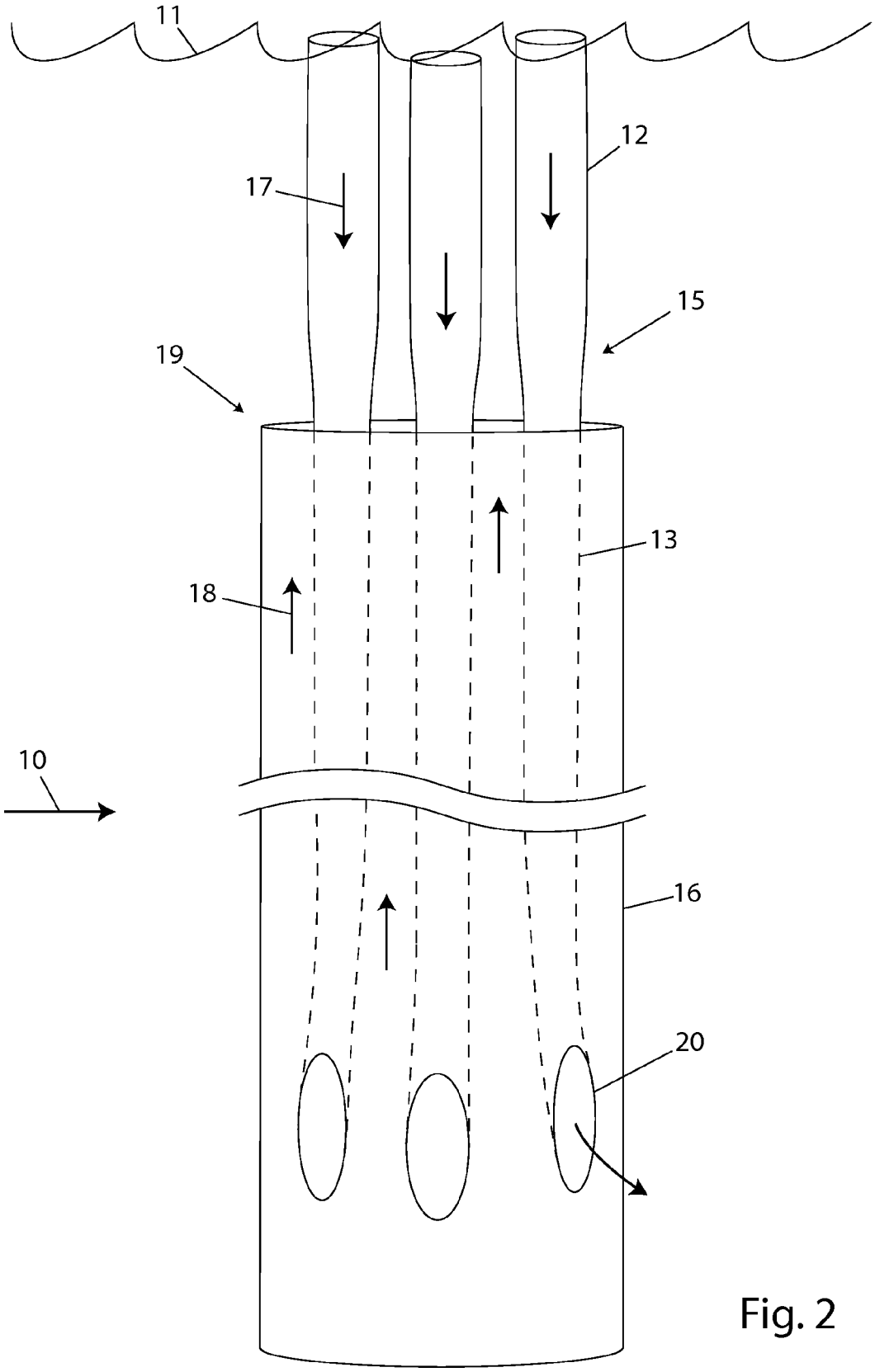
FIG. 2 is a side perspective view of a second embodiment of the invention.

FIG. 2 depicts an alternative embodiment of upwelling device 19 without footer sections of down-flow conduits 14 as depicted in FIG. 1. The heat exchange sections of down-flow conduits 13 terminate at down-flow egress orifices 20 at an elevation above the lower extent of the upwelling conduit 16. This arrangement may be advantageous if the down-flow efflux is expected to be less dense than the deep water entering the up-flow conduit 16 and the ambient flow 10 is not sufficient to carry the down-flow efflux away and prevent the dilution of the up-flow 18.

Figure 3:
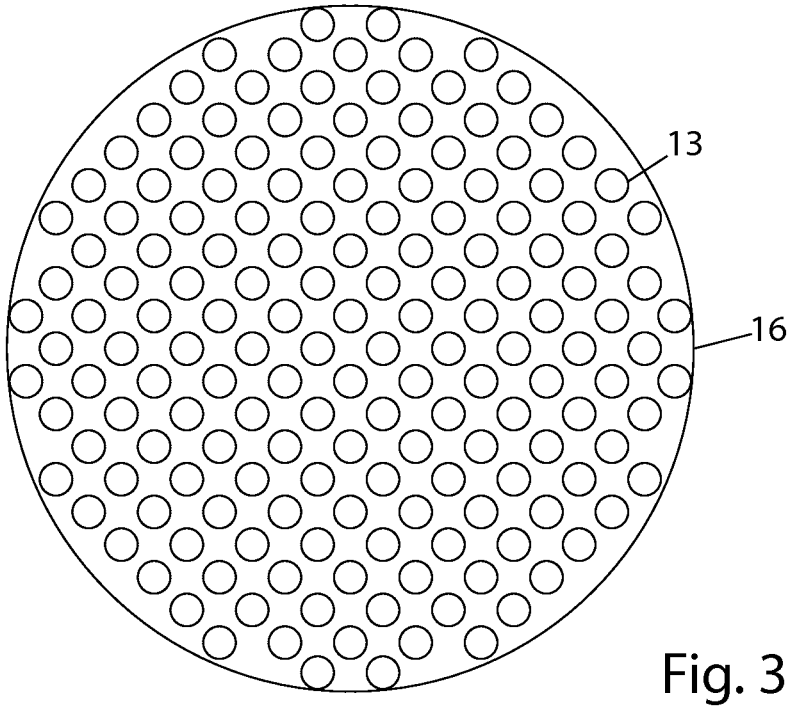
FIG. 3 is a horizontal cross-section of an embodiment of the invention at the midsection with a multitude of down-flow conduits.
Figure 4:
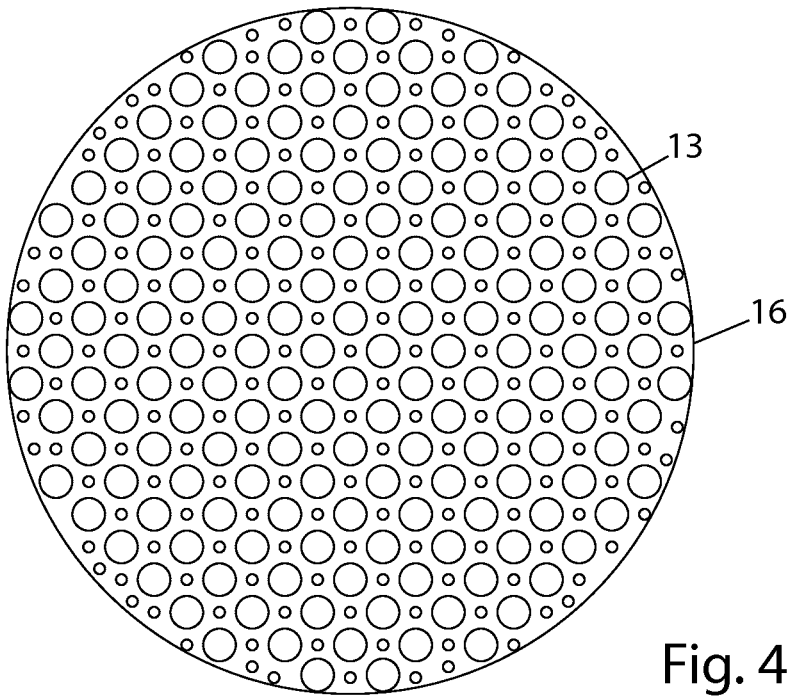
FIG. 4 is a horizontal cross-section of an embodiment of the invention at the midsection with a multitude of down-flow conduits having more than one diameter.

FIG. 3 depicts a horizontal cross-section taken in the middle of an embodiment of the invention with a multitude of down-flow conduits 15. The heat exchange sections of down-flow conduits 13 are sectioned. FIG. 4 depicts a horizontal cross-section taken in the middle of an alternative embodiment of the invention with a multitude of down-flow conduits 15. The heat exchange sections of down-flow conduits 13 are sectioned and have more than one diameter. The upwelling device 19 may be more effective over a wider range of wave-heights with the heat exchange sections of down-flow conduits 13 having more than one diameter.

The preferred embodiment has footer sections of down-flow conduits 14 as depicted in FIG. 1 and a multitude of down-flow conduits 15 as depicted in FIG. 3. Interspersed double or triple ring clamps (not shown) or similar means may be used to constrain the positions of the down-flow conduits 15.

A mass of water contained by the down-flow conduit 15 is subject to three large forces: a force from pressure at the top of the conduit, a force from pressure at the bottom of the conduit, and the force from gravity on the contained water. These three forces are in balance in a quiescent ocean and there is no vertical flow.

Surface waves increase the pressure at the top of the down-flow conduit 15. The three large forces are no longer in balance resulting in the down-flow 17. The dynamic pressure field is known for surface waves (*Theoretical Hydrodynamics* by L. M. Milne-Thompson, 1968, p. 433), therefore the magnitude of the wave pressure can be estimated. The maximum theoretical net pressure imposed on the down-flow conduit 15 is one quarter of the wave height (crest to trough) expressed as head. Though wave pressure varies with amplitude over time at the top of the down-flow conduit 15, it can be treated as constant since the momentum of the water in the down-flow 17 is large.

A consequence of the down-flow 17 is that the weight of the contained water is altered. This change in weight is called the buoyant force and results from of a change of temperature and/or salinity of the contained water.

Another consequence of the down-flow 17 is that friction at the walls of the down-flow conduit 15 must be taken into account when analyzing the flow.

For steady flow in the down-flow conduit 15, $$\psi_{dw}+\psi_{db}+\psi_{df}=0 \quad \text{(equation 1)}$$

where $\psi_{dw}$ is the pressure head from wave pressure, $\psi_{db}$ is the buoyancy pressure head, and $\psi_{df}$ is the pressure head loss from friction.

$\psi_{db}$ is a function of the density of the contained water. The density of seawater is a known function of salinity and temperature. The salinity of the down-flow 17 is the same as the salinity of the ocean at the surface. The temperature of the down-flow 17 in the header sections of down-flow conduits 12 is assumed to be constant and equal to the surface temperature of the ocean. The temperature of the down-flow 17 in the heat exchange sections of down-flow conduits 13 is the average of the surface temperature of the ocean and the egress temperature. The temperature of the down-flow 17 in the footer sections of down-flow conduits 14 is assumed to be constant and equal to the egress temperature. Once the densities are determined, $$\psi_{db}=L_h(1-\rho_h/\rho_{ha})+L_e(1-\rho_e/\rho_{ea})+L_f(1-\rho_f/\rho_{fa}) \quad \text{(equation 2)}$$

where $L_h$ is the length of the header sections of down-flow conduits 12, $\rho_h$ is the density in the header sections of down-flow conduits 12, $\rho_{ha}$ is the average ambient density for the header sections of down-flow conduits 12, $L_e$ is the length of the heat exchange sections of down-flow conduits 13, $\rho_e$ is the average density in the heat exchange sections of down-flow conduits 13, $\rho_{ea}$ is the average ambient density for the heat exchange sections of down-flow conduits 13, $L_f$ is the length of the footer sections of down-flow conduits 14, $\rho_f$ is the density in the footer sections of down-flow conduits 14, and $\rho_{fa}$ is the average ambient density for the footer sections of down-flow conduits 14.

To obtain a pressure head loss from friction it is convenient to use the Darcy-Weisbach expression:

$$\psi_f=(fLV^2)/(2Dg) \quad \text{(equation 3)}$$

where $\psi_f$ is the pressure head loss from friction, f is the Darcy friction factor, L is the length of the conduit, V is the velocity of flow, D is the hydraulic diameter, and g is the acceleration due to gravity. Because of differences in velocity and hydraulic diameter, the friction head losses are calculated separately for the header sections of down-flow conduits 12, the heat exchange sections of down-flow conduits 13, and footer sections of down-flow conduits 14.

For steady flow in the up-flow conduit 16, $$\psi_{ub}+\psi_{uf}=0 \quad \text{(equation 4)}$$

where $\psi_{ub}$ is the buoyancy pressure head for the up-flow, and $\psi_{uf}$ is the pressure head loss from friction in the up-flow.

As the down-flow 17 cools and the up-flow 18 warms, there is a transfer of heat energy from down-flow 17 to up-flow 18. The principle of conservation of energy requires that the rate at which heat energy is lost in the down-flow 17 is equal to the rate at which heat energy is gained in the up-flow 18. This rate of heat energy transfer is also equal to the rate that heat energy crosses the heat exchange area.

$$UAT_{lm}=\dot{m}_d(T_1-T_2)c_pN \quad \text{(equation 5)}$$

$$UAT_{lm}=\dot{m}_u(T_3-T_4)c_p \quad \text{(equation 6)}$$

where $U=1/(1/h_d+1/h_u+1/h_c)$ is the overall heat conductance of the exchanger, A is the area of the heat exchange surface, $T_{lm}$ is the log-mean temperature difference across the heat exchanger, $\dot{m}_d$ is the mass flow rate of one down-flow conduit 15, $T_1$ is the surface temperature of the ocean, $T_2$ is the down-flow egress temperature, N is the number of down-flow conduits of identical dimensions, $\dot{m}_u$ is the mass flow rate of the up-flow 18, $T_3$ is the egress temperature of the up-flow 18, $T_4$ is the temperature of the ocean at the up-flow ingress depth, $h_d$ is the convective heat transfer coefficient for the down-flow, $h_u$ is the convective heat transfer coefficient for the up-flow, and $h_c$ is the conductance of the heat exchange conduit material.

A common method of determining convective heat transfer coefficients is with the Dittus-Boelter equation. For the down-flow 17, $$Nu_d=0.0265Re_d^{0.8}Pr^{0.3} \quad \text{(equation 7)}$$

where $Nu_d=h_dD_d/k$ is the Nusselt number for the down-flow 17, $Re_d=\rho V_dD_d/\mu$ is the Reynolds number for the down-flow 17, $Pr=c_p\mu/k$ is the Prandtl number, $D_d$ is the hydraulic diameter for a single down-flow conduit in the heat exchange section of down-flow conduits 13, k is the heat conductivity of seawater, ρ is the density of seawater, $V_d$ is the velocity of the down-flow 17 in the heat exchange section of down-flow conduits 13, μ is the viscosity of seawater, and $c_p$ is the specific heat of seawater.

For the up-flow 18, $$Nu_u=0.0243Re_u^{0.8}Pr^{0.4} \text{ (equation 8)}$$

where $Nu_u=h_uD_u/k$ is the Nusselt number for the up-flow 18, $Re_u=\rho V_uD_u/\mu$ is the Reynolds number for the up-flow 18, $D_u$ is the hydraulic diameter for the up-flow 18, and $V_u$ is the velocity of the up-flow 18.

Solving equations 1, 4, 5 and 6 simultaneously yields upwelling predictions with the following conduit dimensions of the preferred embodiment:

Upwelling conduit 16 has a diameter of 3.4 meters

Upwelling conduit 16 extends between the depths of 50 meters and 280 meters.

There are 93 down-flow conduits 15 extending to a depth of 300 meters.

The heat exchange sections of down-flow conduits 13 have diameters of 0.23 meters.

The header sections of down-flow conduits 12 have diameters of 0.3 meters.

The header sections of down-flow conduits 12 have lengths of 50 meters.

The footer sections of down-flow conduits 14 have diameters of 0.3 meters.

The footer sections of down-flow conduits 14 have lengths of 20 meters.

Temperature and salinity profiles used in the analysis are listed in table 1 and reflect possible conditions in the North Pacific:

TABLE 1

| Depth (meters) | Salinity (ppt) | Temperature (degrees C.) |
|---|---|---|
| 0 | 35.5 | 15.2 |
| 50 | 35.4 | 12 |
| 100 | 35.3 | 10.2 |
| 150 | 35.2 | 9.2 |
| 200 | 35.1 | 8.8 |
| 250 | 35.0 | 8.2 |
| 300 | 34.9 | 7.8 |

The calculated results of the preferred embodiment with the given dimensions and the given temperature and salinity profiles are listed in table 2 for two wave-heights (peak-to-trough):

TABLE 2

| | 1 meter wave | 2 meter wave |
|---|---|---|
| Down-flow egress temperature (degrees Celsius) | 11.6 | 12.3 |
| Down-flow heat transfer coefficient (watts per square meter degree Kelvin) | 973 | 1364 |
| Down-flow Reynolds Number (heat-exchange section) | 67471 | 102885 |
| Up-flow rate (cubic meters per second) | 1.40 | 1.51 |
| Up-flow egress temperature (degrees Celsius) | 12.1 | 12.6 |
| Up-flow heat transfer coefficient (watts per square meter degree Kelvin) | 780.5 | 831.5 |
| Up-flow Reynolds Number | 52540 | 56628 |
| Rate of heat energy exchange (megawatts) | 22.5 | 27.2 |

In the top several hundred meters in the North Pacific, the concentration of nitrate increases approximately linearly by 6.5 μmoles per liter for every 100 meters depth, and phosphate concentration increases by 0.5 μmoles per liter for every 100 meters depth (*Marine Geochemistry* edited by Horst D. Schulz and Matthias Zabel, 2006, page 208). With the aforementioned dimensions, upwelling device 19 adds nitrate to the photic zone at a rate of 14.95 millimoles per cubic meter of upwelling. The amount of phosphate added is 1.15 millimoles per cubic meter of upwelling. At a rate of 1.4 cubic meters per second, a single upwelling device 19 is delivering 112 kilograms of nitrate and 13.2 kilograms of phosphate to the photic zone each day.

From the description above, a number of advantages to the heat exchange method of artificial upwelling become evident. The invention has no moving parts. This makes it easier to build and gives it less chance for failure. The invention does not require intervention for its operation. It can be left unattended in the remote ocean utilizing the power from waves to function. Another advantage of the invention is that the deep ocean water that is transported and released into the photic zone is warmed to the extent that the density of the efflux is nearly the same density as that of the ambient water, and will not sink below the photic zone. Yet another advantage is that the invention can be designed theoretically and a substantial upwelling predicted by those practiced in the art of the fluid mechanics of heat exchangers.

CONCLUSIONS AND RAMIFICATIONS

The heat exchange method of artificial upwelling mimics the natural process of oceanic upwelling wherein deep ocean water rises into the photic zone and provides a nutrient rich environment for phytoplankton, the beginning of the marine food chain. The invention makes effective and novel use of wave power to transport warm surface water of the ocean to the depths. The result is that heat is transferred to the deep nutrient-rich water. The deep water consequently increases in temperature, becomes buoyant, and rises into the photic zone of the ocean to deliver nutrients where photosynthesis occurs. This invention can convert an oceanic desert environment into a fertile ocean environment. Approximately half of the surface of the earth is an oceanic desert environment. The present invention can increase the value of much of this area. This fertile ocean environment can be used for aquaculture and to restore and also to enhance marine populations. The present invention vertically mixes ocean water which has a multitude of other advantages.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. An apparatus for mixing layers of an ocean comprising:

a main duct comprising a vertically elongated wall, an interior space being defined within said main duct, an upper open end of said main duct terminating below a surface of the ocean, a lower open end of said main duct terminating below said upper open end of said main duct, and a plurality of orifices at the lower end of said main duct;

a plurality of elongated conduits extending vertically within said interior space of said main duct, wherein the upper end of each plurality of elongated conduits extends vertically above said upper end of said main duct, wherein each said upper end of said plurality of elongated conduits terminates in an area of the ocean experiencing increased pressure due to ocean surface waves, the lower end of each plurality of elongated conduits terminates at one of said orifice in said lower end of said main duct;

said plurality of elongated conduits each being composed of a heat insulating material at the upper portion of said conduits and said plurality of elongated conduits each being composed of a heat conducting material at the lower portion of said conduits, wherein the heat insulating material and the heat conducting material are different materials; and wherein said plurality of elongated conduits provides a plurality a down-flow passages of ocean water from the surface of said ocean to said orifices of said main duct and said main duct provides an up-flow passage of ocean water from said lower end of said main duct to said upper end of said main duct.

2. The apparatus of claim 1 wherein a subset of said elongated conduits terminate below said lower open end of said main duct.

3. A method for mixing layers of an ocean comprising:

(a) causing water from a first predetermined depth to rise and be discharged at a second predetermined depth, wherein the first predetermined depth is deeper than the second predetermined depth;

(b) causing surface water to descend in a direction opposite to the rising water and be discharged at a third predetermined depth;

(c) confining the rising and discharging of the water from the first predetermined depth to a first flow path and confining the descension and discharging of the surface water to a second flow path;

(d) providing and positioning a plurality of elongated conduits confining the second flow path so that upper ends of said conduits are in the vicinity of increased pressure due to surface waves whereby said increased pressure effects flow in said conduits;

(e) utilizing increased pressure at the surface due to surface waves as an impetus for said descension without the need for external drive means;

(f) providing an elongated heat exchange surface and exchanging heat between the first flow path and the second flow path whereby a buoyancy results in the first flow path and wherein said plurality of elongated conduits each being composed of a heat insulating material at the upper portion of said conduits and said plurality of elongated conduits each being composed of a heat conducting material at the lower portion of said conduits, wherein the heat insulating material and the heat conducting material are different materials; and (g) said buoyancy providing an impetus for the rising.

4. The method of claim 3 wherein:

(a) said first flow path contains turbulent flow, and;

(b) said second flow path contains turbulent flow.

5. An apparatus for mixing layers of an ocean comprising:

a main duct comprising a vertically elongated wall, an interior space being defined within said main duct, an upper open end of said main duct terminating below a surface of the ocean, and a lower open end of said main duct terminating below said upper open end of said main duct, a plurality of elongated conduits extending vertically within said interior space of said main duct, wherein the upper end of each plurality of elongated conduits extends vertically above said upper end of said main duct, wherein each said upper end of said plurality of elongated conduits terminates in an area of the ocean experiencing increased pressure due to ocean surface waves, the lower end of each plurality of elongated conduits extends vertically below said lower end of said main duct and terminates below said lower end of said main duct;

said plurality of elongated conduits each being composed of a heat insulating material at the upper portion of said conduits and said plurality of elongated conduits each being composed of a heat conducting material at the lower portion of said conduits, wherein the heat insulating material and the heat conducting material are different materials; and wherein said plurality of elongated conduits provides a plurality of down-flow passages of ocean water from the surface of said ocean to an area below said lower end of said main duct and said main duct provides an up-flow passage of ocean water from said lower end of said main ductto said upper end of said main duct.

* * * * *